US008506334B2

(12) United States Patent
Abraham

(10) Patent No.: US 8,506,334 B2
(45) Date of Patent: Aug. 13, 2013

(54) BATTERY CONNECTOR WITH LID FOR EASY DISCONNECT

(75) Inventor: Euan Abraham, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 53 days.

(21) Appl. No.: 12/894,460

(22) Filed: Sep. 30, 2010

(65) Prior Publication Data

US 2012/0083170 A1 Apr. 5, 2012

(51) Int. Cl.
*H01R 13/10* (2006.01)

(52) U.S. Cl.
USPC ..... 439/682; 439/500

(58) Field of Classification Search
USPC ..... 439/500, 499, 374; 429/99, 100
See application file for complete search history.

(56) References Cited

U.S. PATENT DOCUMENTS

| | | | | |
|---|---|---|---|---|
| 4,835,410 | A * | 5/1989 | Bhagwat et al. | 307/64 |
| 5,201,671 | A * | 4/1993 | Elias | 439/483 |
| 5,317,247 | A * | 5/1994 | Chong et al. | 320/112 |
| 5,552,958 | A * | 9/1996 | Seto et al. | 361/679.55 |
| 6,179,642 | B1 * | 1/2001 | Hwang | 439/358 |
| 6,373,693 | B1 * | 4/2002 | Seto et al. | 361/679.33 |
| 6,597,572 | B2 * | 7/2003 | Nishikawa et al. | 361/695 |
| 6,840,796 | B2 * | 1/2005 | Marcinkiewicz et al. | 439/495 |
| 7,121,899 | B2 * | 10/2006 | Homann et al. | 439/680 |
| 7,965,495 | B2 * | 6/2011 | Hendren et al. | 361/679.01 |
| 2005/0130490 | A1 * | 6/2005 | Rose | 439/483 |

FOREIGN PATENT DOCUMENTS

JP 2001256936 * 9/2001

* cited by examiner

*Primary Examiner* — Phuong Dinh
(74) *Attorney, Agent, or Firm* — Kilpatrick Townsend & Stockton

(57) ABSTRACT

Battery connectors that have a small size, are easily connected and disconnected during manufacturing and repair, are resistant to misconnection, and during connection, form electrical contact for one or both power pins before a signal pin. In one example, size may be reduced by providing a lid having a flat surface. Another example may provide a lid that extends beyond an edge of the socket in one or more directions to allow the lid to be pried with a finger during removal. Another example may provide a socket that is keyed using a negative space, which may mate with an open space in the lid. This mating may prevent the lid from being misconnected with the socket during manufacturing or repair. Another example may provide signal pins having a lower height than power and ground pins, such that power and ground connections are formed first when a battery is connected.

25 Claims, 15 Drawing Sheets

SECTION F-F

SECTION E-E

BATTERY CONNECTOR WITH LID FOR EASY DISCONNECT

BACKGROUND

The numbers and types of portable electronic devices that are available to consumers have proliferated the past several years. Media players, handheld media players, cell phones, smart phones, table computers, and other devices have become ubiquitous.

Typically, each of these devices includes a battery. This battery provides power when the portable device is away from an external power source, such as a wall outlet. This battery may be a rechargeable battery or a non-rechargeable battery. In either event, the battery needs to be connected to circuitry inside the electronic device so that the battery may provide power to the electronic device. Accordingly, a battery connector may be used to connect the battery to circuitry inside the electronic device.

But these battery connectors consume space inside the electronic devices. This space consumption means either that the electronic device is larger than it would otherwise be, or that the electronic device includes less functionality than it otherwise might (or a combination of both). Thus, it may be desirable to provide battery connectors having a smaller size.

Also, these battery connectors may be connected during device manufacturing. And, on occasion, the battery may need to be replaced. To facilitate manufacturing and repair of these electronic devices, it may be desirable that these battery connectors are easy to connect and disconnect.

Moreover, battery packs may include circuitry to allow them to communicate with circuits in the electronic device. To facilitate this communication, the battery packs may include a signal pin. To protect this signal pin from being shorted to a power supply, it may be desirable to provide a battery connector that is less likely to be misconnected. Also, to further protect the signal pins, it may be desirable to ensure that, when the battery connector is connected, one or more power pins are connected before the signal pin is connected.

Accordingly, what is needed are circuits, methods, and apparatus that provide battery connectors having a small size, are easily connected and disconnected in a manufacturing environment, are resistant to misconnection, and during connection, form electrical contact for one or both power pins before a signal pin.

SUMMARY

Accordingly, embodiments of the present invention may provide battery connectors that have a small size, are easily connected and disconnected in a manufacturing environment, are resistant to misconnection, and during connection, form electrical contact for one or both power pins before a signal pin.

An illustrative embodiment of the present invention may provide a battery connector having a socket and a lid, where contacts in the socket may mate with contacts in the lid to form electrical paths. The socket contacts may connect to pins, which may in turn connect to traces of a printed circuit board. Contacts in the lid may connect through a flexible cable to a battery pack. This illustrative embodiment of the present invention may have a small size. This diminutive size may be achieved in part by having a low profile due to a flat lid. In other embodiments of the present invention, the lid may have other shapes.

Another illustrative embodiment of the present invention may provide a battery connector that is easily connected and disconnected in a manufacturing environment. This illustrative embodiment may provide a lid that extends beyond one or more edges of the socket in one or more directions. In this embodiment of the present invention, this allows the extended portion or portions of the lid to be pried with a force exerted by one or more fingers to remove the lid and disconnect the battery from internal circuitry.

Another illustrative embodiment of the present invention may provide a socket that is keyed using a negative space. This negative space, or key, may mate with an open space in the lid. This mating may prevent the lid from being misconnected with the socket during manufacturing or repair.

Still another illustrative embodiment of the present invention may provide a socket having signal pins at a lower height than a power and a ground pin. In this way, when a lid is mated to the socket, power and ground connections are formed before the signal line is connected. This protects the signal line from damage and prevents the battery pack from powering up before the power connections in the battery connector are made.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1A:
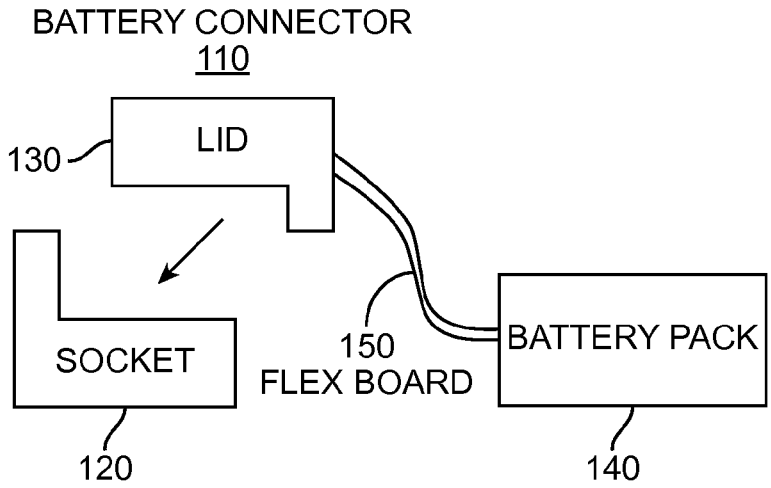
FIGS. 1A-1B illustrate a battery connector system according to an embodiment of the present invention.
Figure 1B:
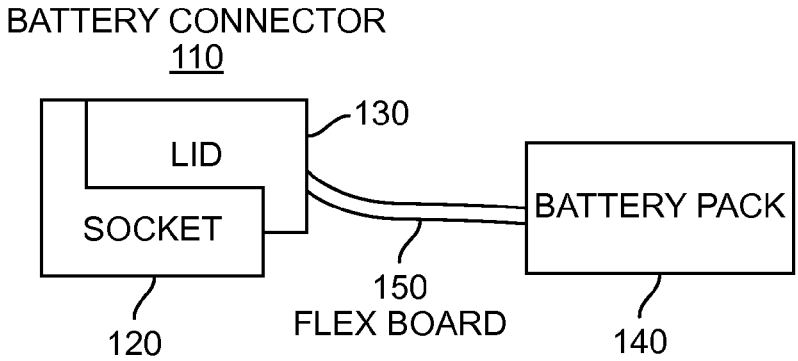

FIGS. 1A-1B illustrate a battery connector system according to an embodiment of the present invention. FIG. 1A illustrates a battery connector system including battery connector 110, where battery connector 110 may be disconnected. FIG. 1B illustrates battery connector system including battery connector 110, where battery connector 110 may be connected. These figures, as with the other included figures, are shown for illustrative purposes and do not limit either the possible embodiments of the present invention or the claims.

FIG. 1A illustrates a battery connector system including battery connector 110, the battery connector 110 including socket 120 and lid 130, battery pack 140, and flexible circuit board 150. In this figure, lid 130 may be separate or disconnected from socket 120. Lid 130 may be attached to battery pack 140 via flexible circuit board 150. In various embodiments of the present invention, socket 120 may be attached to a printed circuit board (not shown). Battery pack 140 may also be attached to the printed circuit board. For example, battery pack 140 may be held in place by a clip or other retaining device (not shown) that may be attached to the printed circuit board. Socket 120 may include a number of contacts (not shown) that may connect to traces (not shown) on the printed circuit board. These contacts may form electrical connections to contacts (not shown) in lid 130. These contacts in lid 130 may connect to conductors (not shown) in flexible circuit board 150. The conductors in flexible circuit board 150 may in turn connect to terminals (not shown) in battery pack 140. In this way, terminals in battery pack 140 may be connected to traces on the printed circuit board.

Battery pack 140 may include a rechargeable or other type of battery (not shown). The battery in battery pack 140 may be charged via battery connector 110, or the battery in battery pack 140 may supply power via battery connector 110. Battery pack 140 may also include circuitry for controlling aspects of the battery. For example, this circuitry may control the charging or discharging of the battery in battery pack 140. In other embodiments of the present invention, this circuitry may control the voltage or power levels provided to or by the battery in battery pack 140. This circuitry may also track the charge level, performance, or other aspects of the battery in battery pack 140.

Flexible circuit board 150 may include a number of conductors, for example conductors for a power supply and one or more signals. In a specific embodiment of the present invention, flexible circuit board 150 includes conductors for power, ground, and a signal. In various embodiments of the present invention, battery pack 140 may communicate with circuitry on a printed circuit board using one or more signals to achieve the functionality described above. In other embodiments of the present invention, flexible circuit board 150 may be replaced by wires or other conductors.

Again, socket 120 may include a number of contacts for a power supply and one or more signals. Specifically, socket 120 may include a number of contacts for power, ground, and a signal. An example is shown in the following figure.

Figure 2:
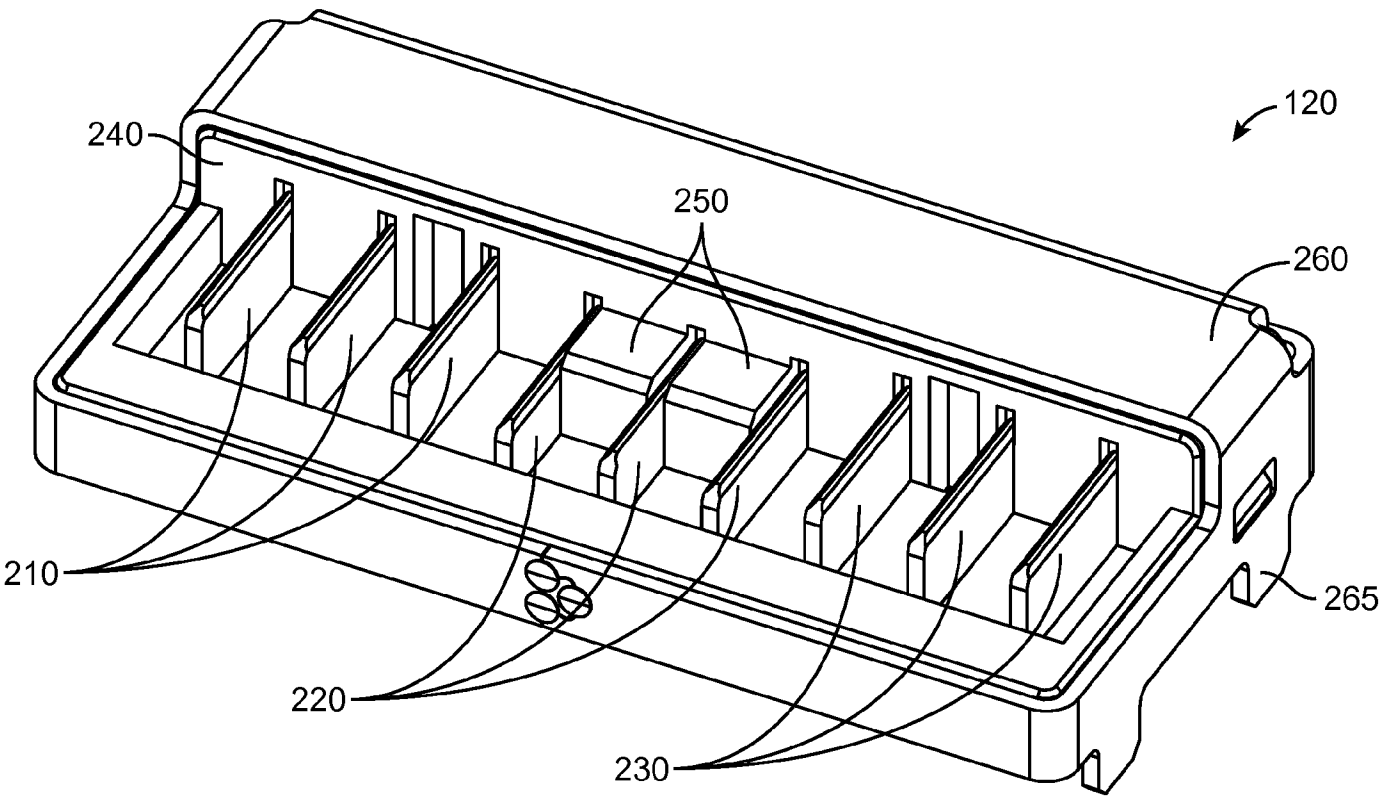
FIG. 2 illustrates a socket according to an embodiment of the present invention.

FIG. 2 illustrates a socket according to an embodiment of the present invention. This socket 120 may include a number of contacts 210, 220, and 230, arranged in an insulative housing 240. Insulative housing 240 may be at least partially surrounded by shield 260. Insulative housing 240 may be formed using plastic, ceramic, or other insulative or non-conductive material. Shield 260 may be formed using aluminum, copper, stainless steel, or other conductive materials.

In this specific embodiment of the present invention, contacts 210 and 230 may convey power and ground signals. Contacts 220 may convey a signal. In other embodiments of the present invention, other contacts may be included, or these contacts may be used for other purposes. Contacts 210, 220, and 230 may be formed using aluminum, copper, stainless steel, or other conductive materials.

In a specific embodiment of the present invention, it may be desirable to ensure that power connections to the battery are formed before the signal path is activated. This may prevent spurious signals from reaching or being provided by battery pack 140. Accordingly, in this embodiment of the present invention, contacts 220 may have a lower height than do contacts 210 and 230. In this way, when lid 130 is attached to receptacle 120, connections may be made at contacts 210 and 230 before they are made at contacts 220.

It may be desirable to avoid a misconnection when lid 130 is attached to socket 120. For example, to protect battery pack 140, it may be desirable to not connect a signal contact in lid 130 to a power supply contact in receptacle 120, or a power supply contact in lid 130 to a signal contact in receptacle 120. Accordingly, insulative housing 240 may include one or more negative spaces or keys 250. Keys 250 may mate with an open space in lid 130. This may ensure that lid 130 mates with socket 120 in only one way, thereby avoiding misconnections between lid 130 and socket 120.

Shield 260 may provide mechanical support and electrical shielding for socket 120. Tabs 265 may be soldered or otherwise connected to a printed circuit board for mechanical stability.

Figure 3:
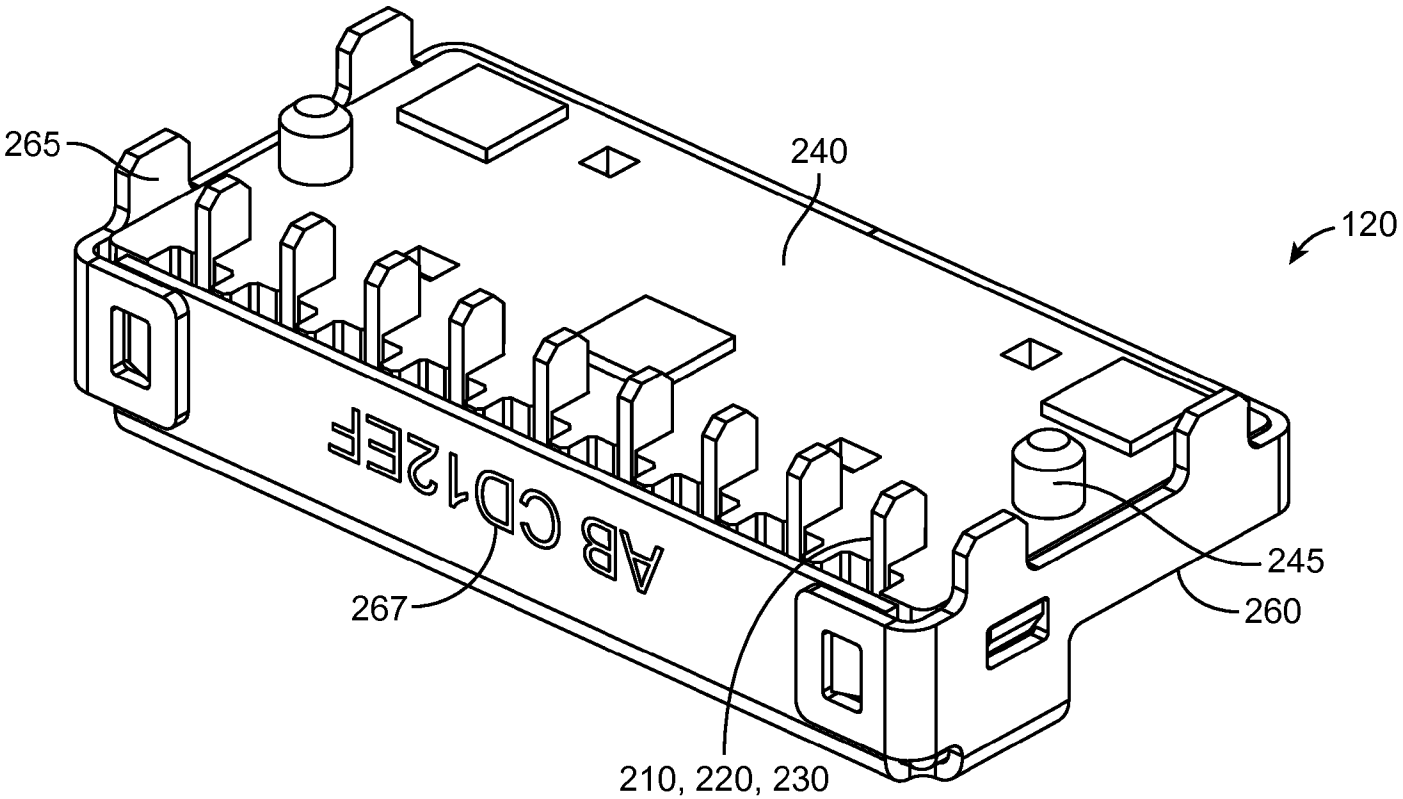
FIG. 3 illustrates a bottom view of a socket according to an embodiment of the present invention.

FIG. 3 illustrates a bottom view of a socket according to an embodiment of the present invention. In this example, a bottom portion of contacts 210, 220, and 230 may be through-hole contacts that are soldered into holes in a printed circuit board. In other embodiments of the present invention, bottoms of contacts 210, 220, and 230 may be surface-mount contacts or other types of contacts. Shield 260 may include tabs 265 for attachment to a printed circuit board. Shield 260 may also include identifying text 267. Insulative housing 240 may include one or more tabs 245 for further mechanical support. Tabs 245 may also be used to ensure proper registration to a printed circuit board. That is, tabs 245 may be used to properly position socket 120 relative to a printed circuit board.

Figure 4:
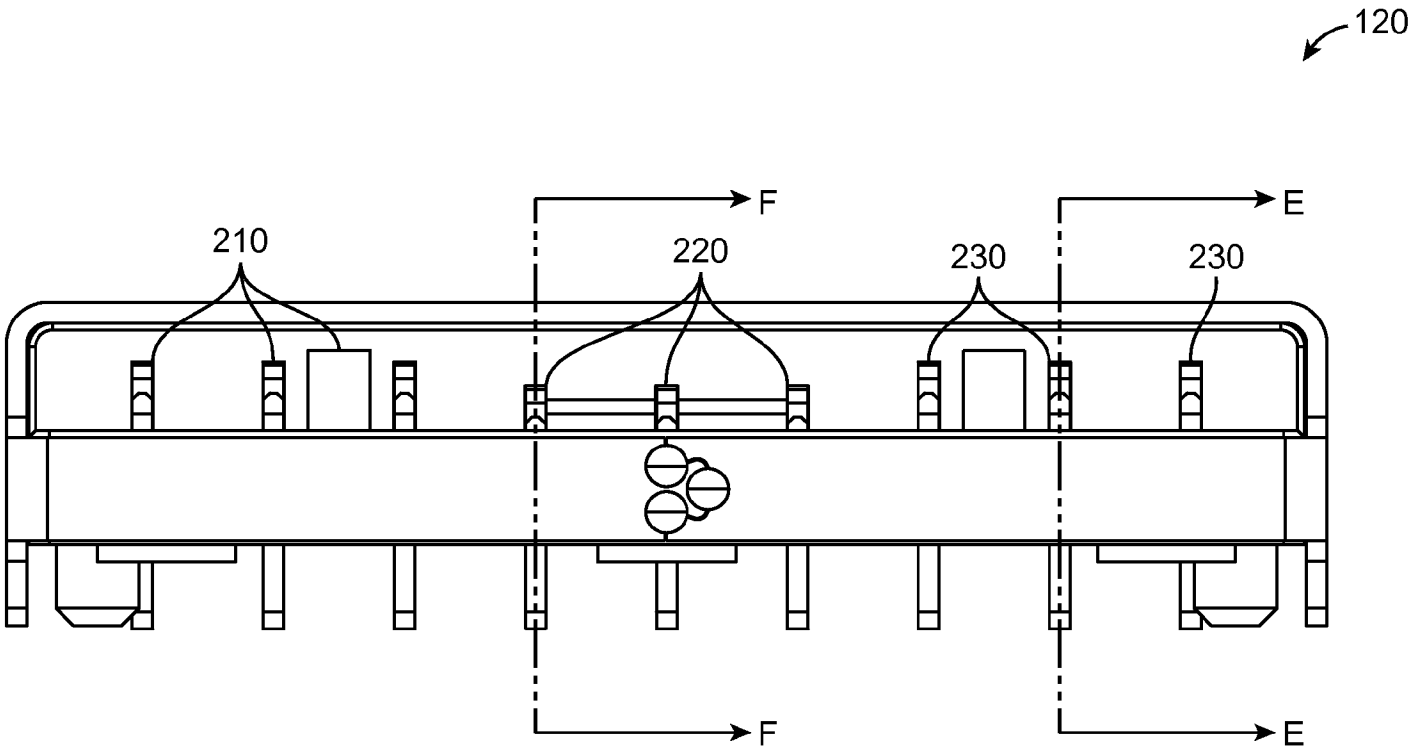
FIG. 4 illustrates a side view of a socket according to an embodiment of the present invention.

FIG. 4 illustrates a side view of a socket according to an embodiment of the present invention. Again, contacts 220 may have a lower height than contacts 210 and 230. This may ensure that when lid 130 is attached to socket 120, electrical connections at contacts 210 and 230 are formed before an electrical connection at contacts 220 is formed.

Figure 5:
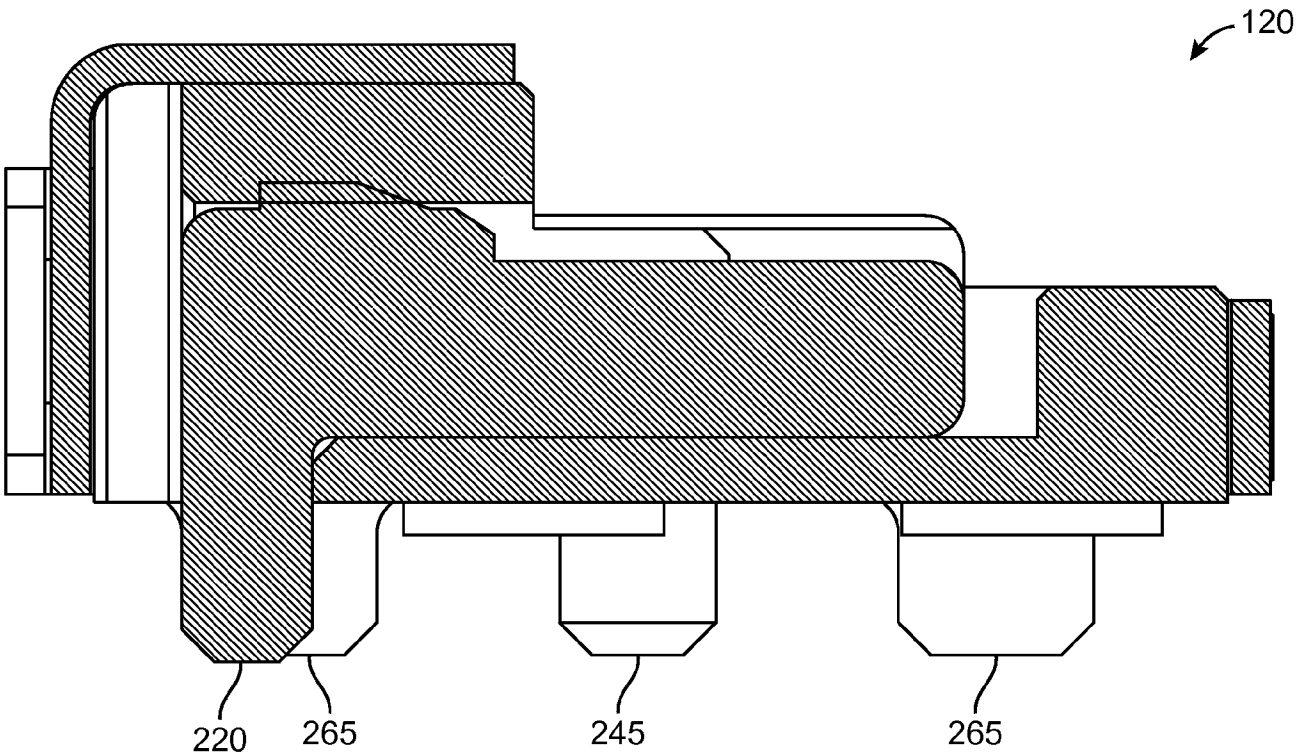
FIG. 5 illustrates a side view of the socket in FIG. 4 along lines F-F.

FIG. 5 illustrates a side view of the socket in FIG. 4 along lines F-F.

Figure 6:
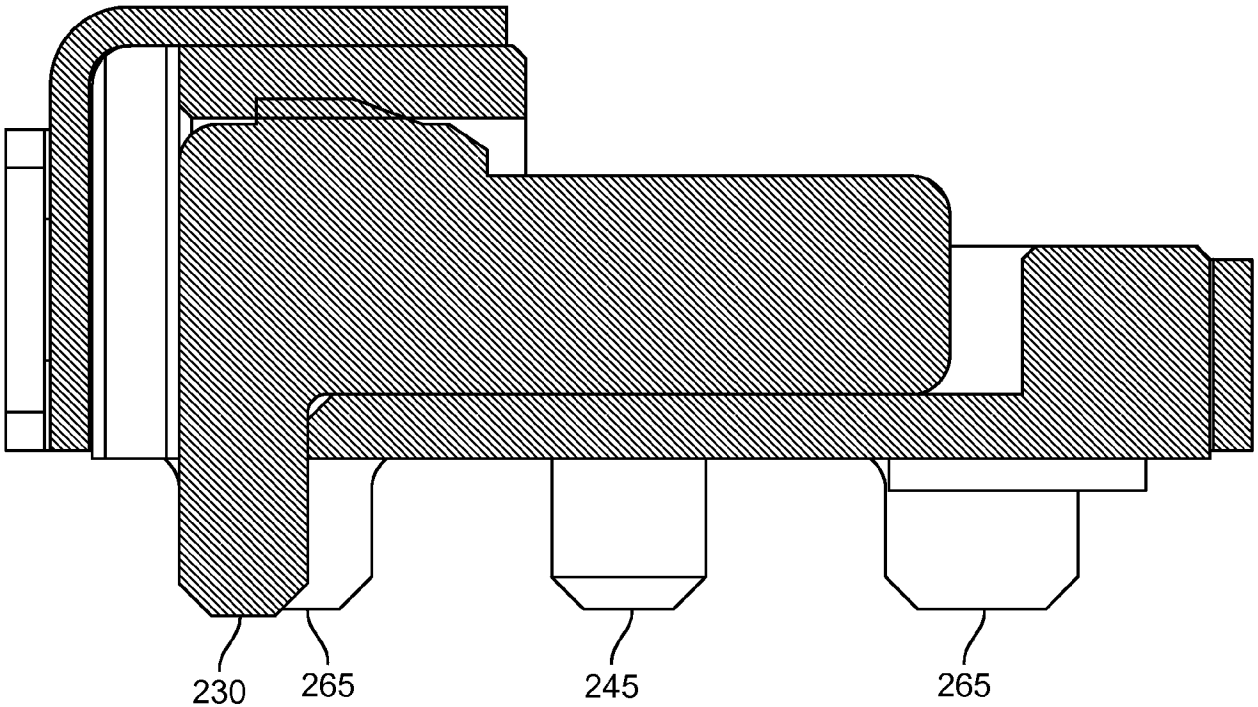
FIG. 6 illustrates a side view of the socket in FIG. 4 along lines E-E.

FIG. 6 illustrates a side view of the socket in FIG. 4 along lines E-E.

Figure 7:
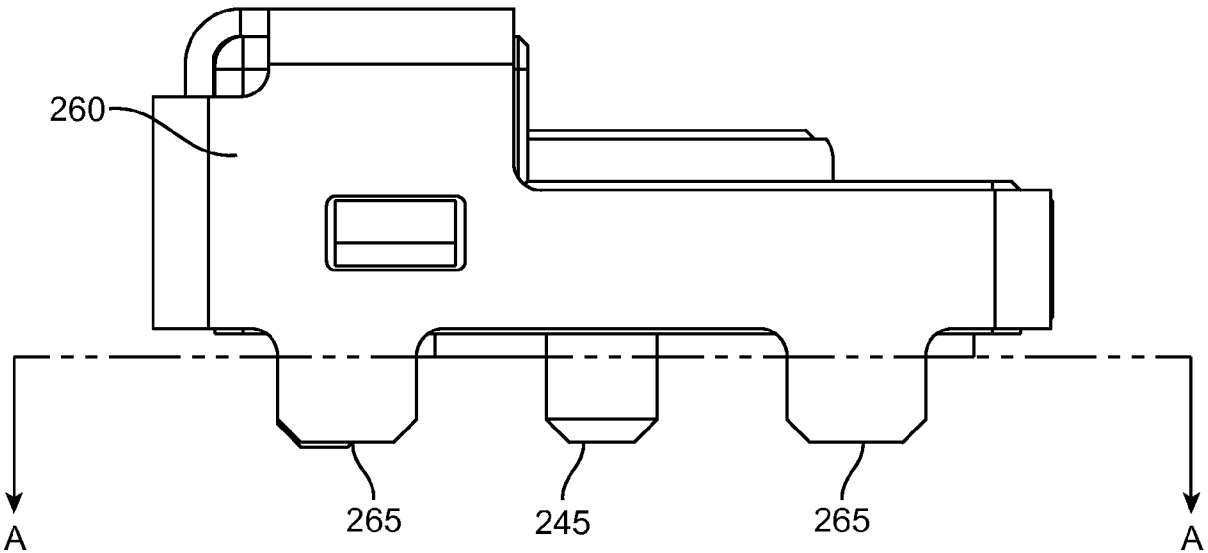
FIG. 7 illustrates a side view of a socket according to an embodiment of the present invention.

FIG. 7 illustrates a side view of a socket according to an embodiment of the present invention.

Figure 8:
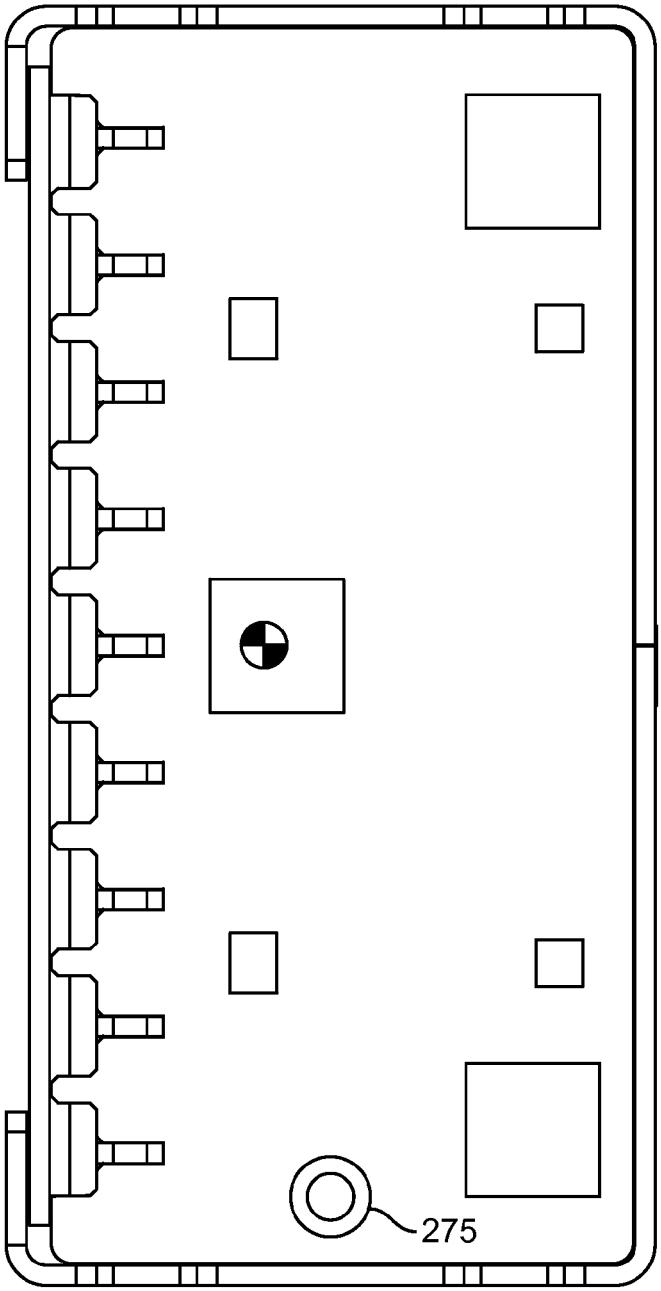
FIG. 8 illustrates a bottom view of a socket according to an embodiment of the present invention.

FIG. 8 illustrates a bottom view of a socket according to an embodiment of the present invention.

Figure 9:
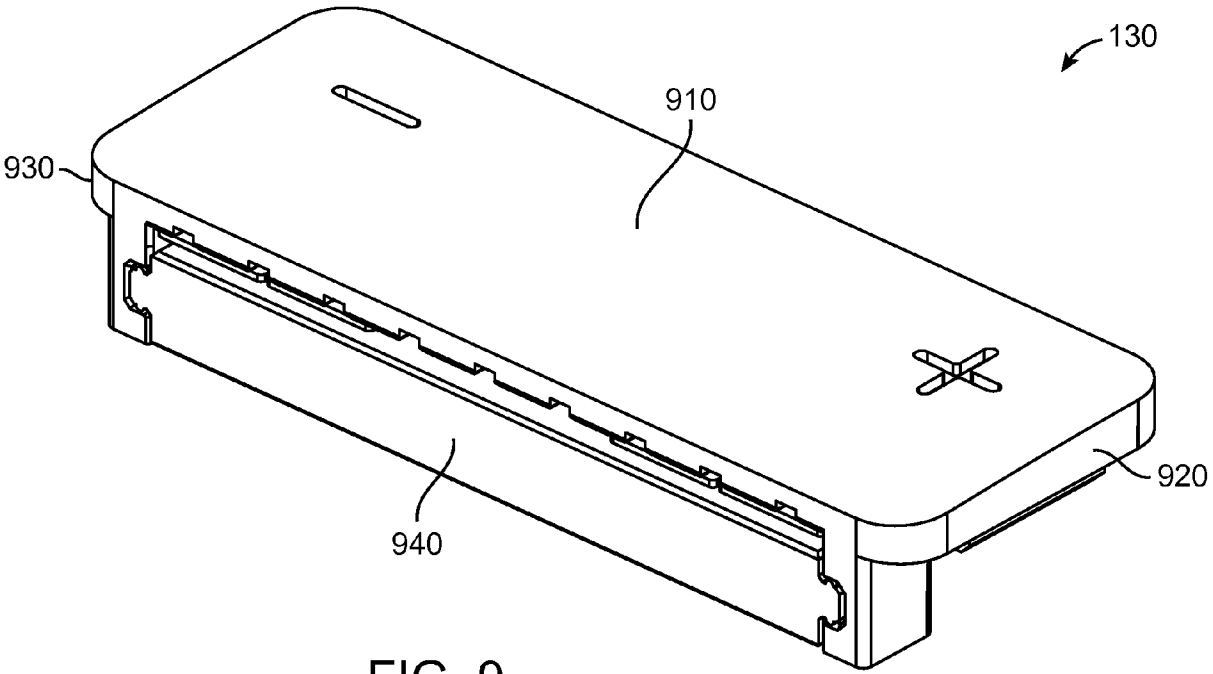
FIG. 9 illustrates a top view of a lid according to an embodiment of the present invention.

FIG. 9 illustrates a top view of a lid according to an embodiment of the present invention. Lid 130 may include top surface 910 having edges 920 and 930. In this specific embodiment of the present invention, edges 920 and 930 may extend beyond socket 120. This enables edges 920 and 930 to be grasped by a user in order to remove lid 130 from socket 120. In other embodiments of the present invention, only one edge may extend beyond socket 120. In other embodiments, three or more edges may extend beyond socket 120. While in this example edges on the shorter sides of lid 130 are shown as being extended, in other embodiments of the present invention, other edges may be extended beyond socket 120. For example, the longer edges of top surface 910 may extend beyond socket 120. Top surface 910 may be flexible in order to facilitate its removal in this way. Piece 940 may attach to flexible connector 150.

In this example, top surface 910 may be at least substantially flat. This may provide the battery connector 110 with a low profile. This low profile may save space, allowing the electronic device in which it is used to be smaller in size or to include more functionality (or a combination of both). In other embodiments of the present invention, top surface 910 of lid 130 may have other shapes.

In this example, lid 130 may be removed by a user applying a force at edges 930 and 930 of top surface 910. This force may be generally upward, though in other embodiments of the present invention, the force may be applied in other directions. This generally upward force may bend top surface 910, thereby facilitating its removal.

Figure 10:
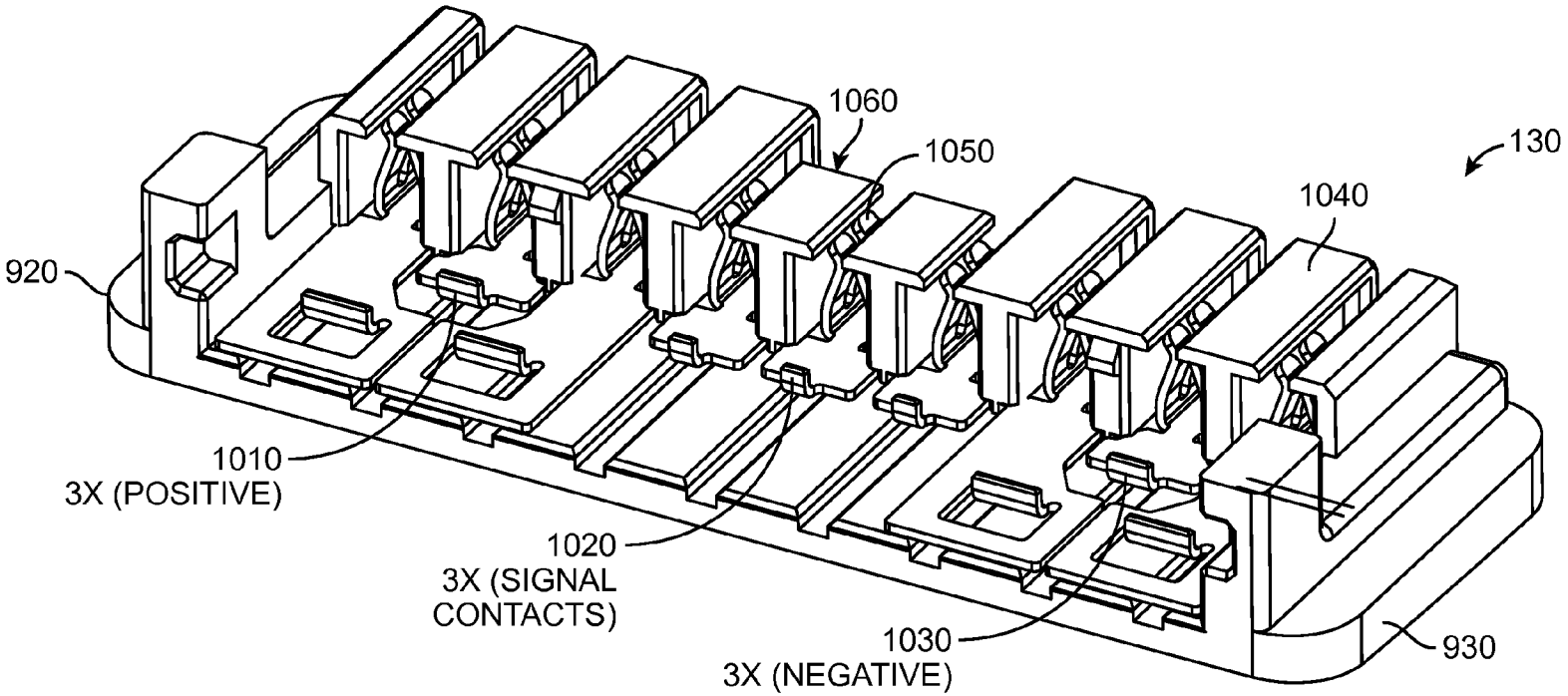
FIG. 10 illustrates a bottom view of a lid according to an embodiment of the present invention.

FIG. 10 illustrates a bottom view of a lid according to an embodiment of the present invention. Again contacts for power, ground, and a signal are included. Specifically, contacts 1010, 1020, and 1030 are included. Contacts 1010, 1020, and 1030 may include prong portions 1050 for mating with contacts 210, 220, and 230 in socket 120. Contacts 1010, 1020, and 1030 may be formed using aluminum, copper, stainless steel, or other conductive materials. Prongs 1050 may be isolated by insulative portions 1040. Insulative portions 1040 may be separate from one another to enhance the flexibility of lid 130. This enhanced flexibility may facilitate its removal from socket 120 when a force is exerted on edges 920 and 930. Open space 1060 may mate with negative space or keys 250 on socket 120. Insulative portions 1040, as well as top surface 910, may be formed using plastic, ceramic, or other insulative or non-conductive material.

Figure 11:
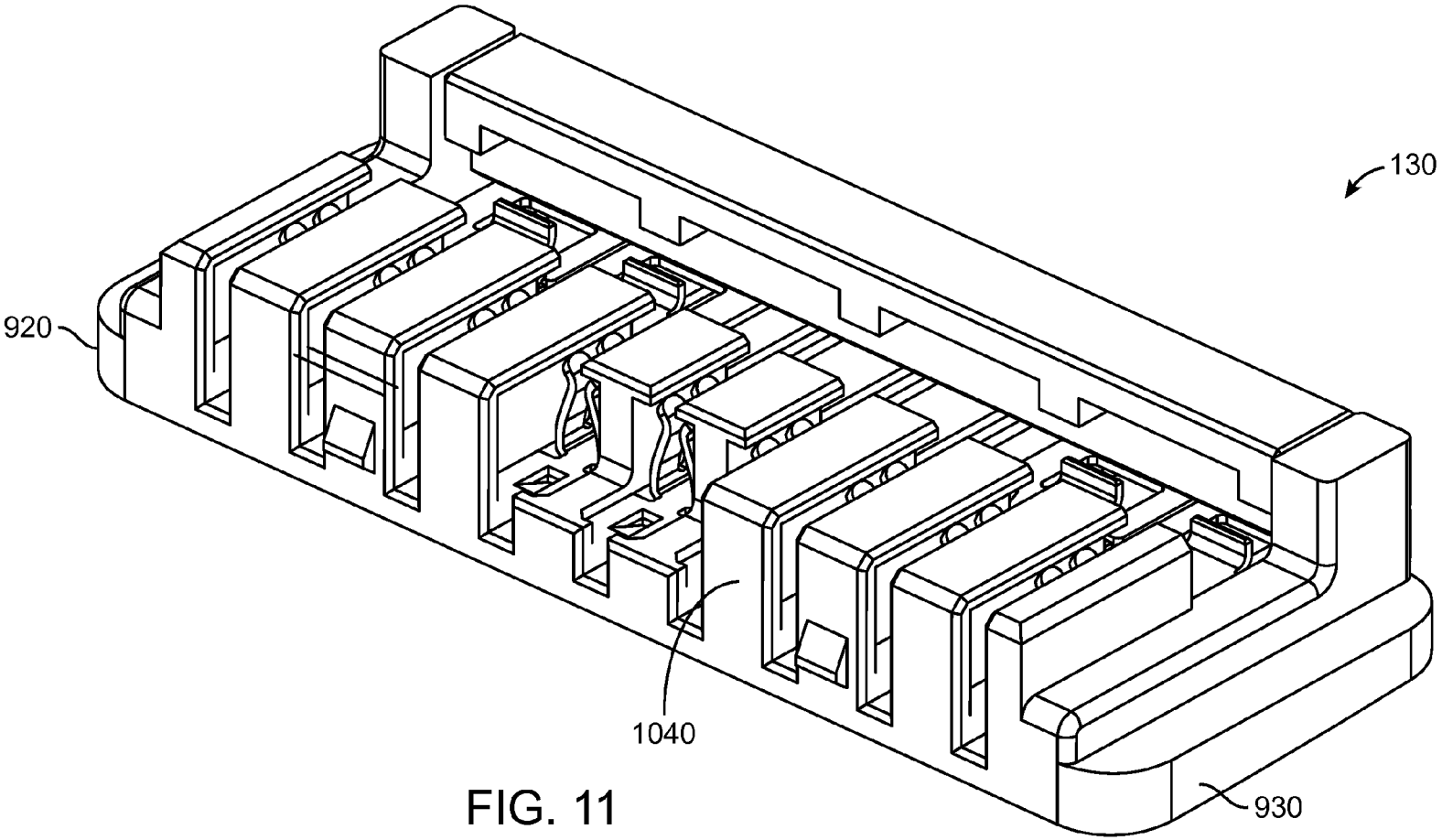
FIG. 11 illustrates another bottom view of a lid according to an embodiment of the present invention.

FIG. 11 illustrates another bottom view of a lid according to an embodiment of the present invention.

Figure 12:
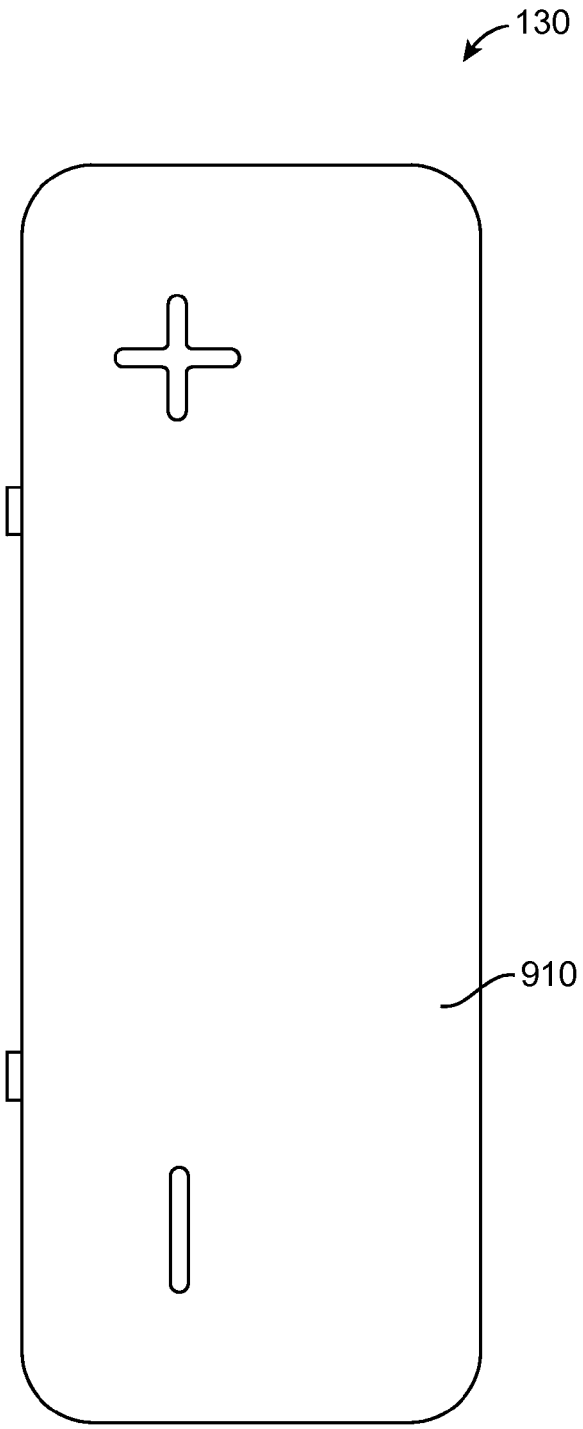
FIG. 12 illustrates a top view of a lid according to an embodiment of the present invention.

FIG. 12 illustrates a top view of a lid according to an embodiment of the present invention.

Figure 13:
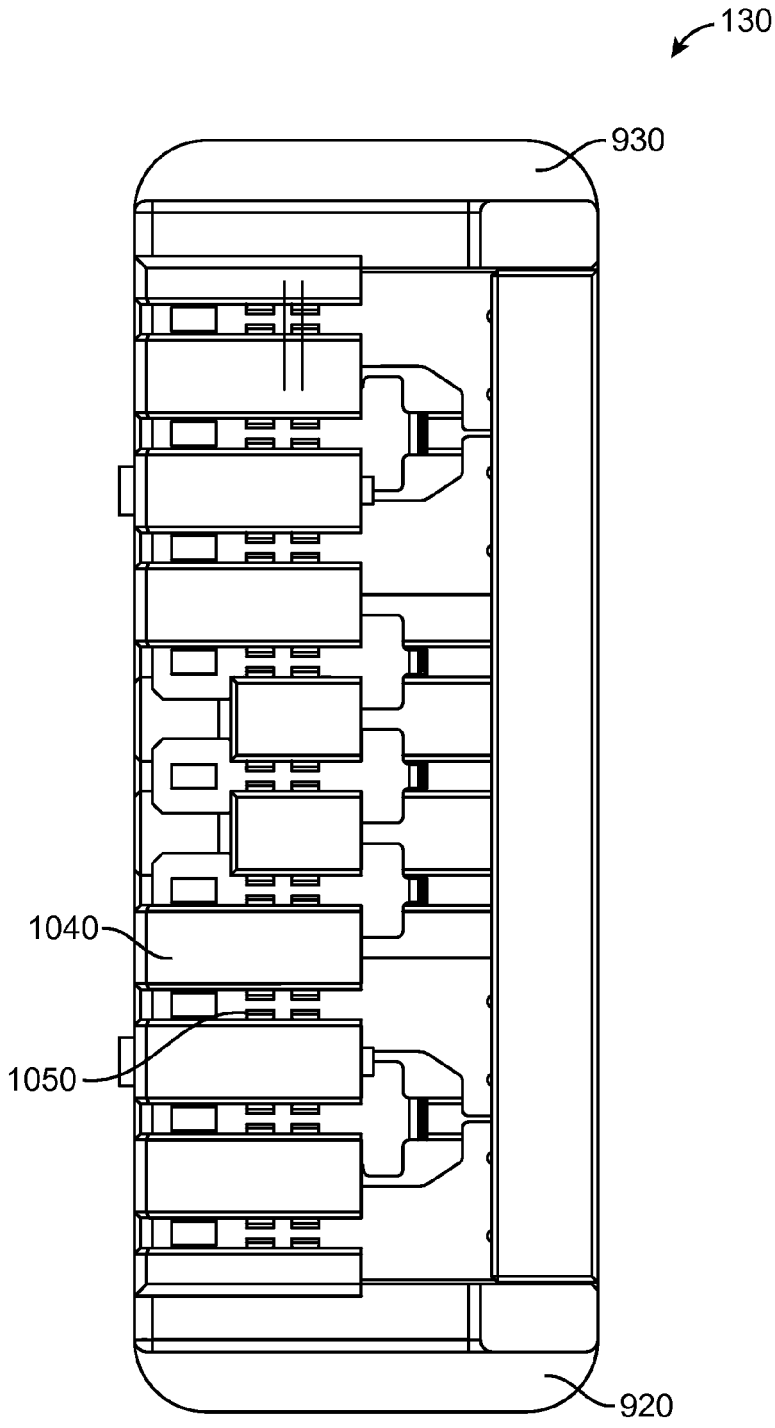
FIG. 13 illustrates a bottom view of a lid according to an embodiment of the present invention.

FIG. 13 illustrates a bottom view of a lid according to an embodiment of the present invention. Again, edges 920 and 930 may extend beyond receptacle 120. A user may apply a force at edges 920 and 930, thereby causing lid 130 to bend, thereby facilitating its removal. Insulative portions 1040 may isolate contact prongs 1050 from one another.

Figure 14:
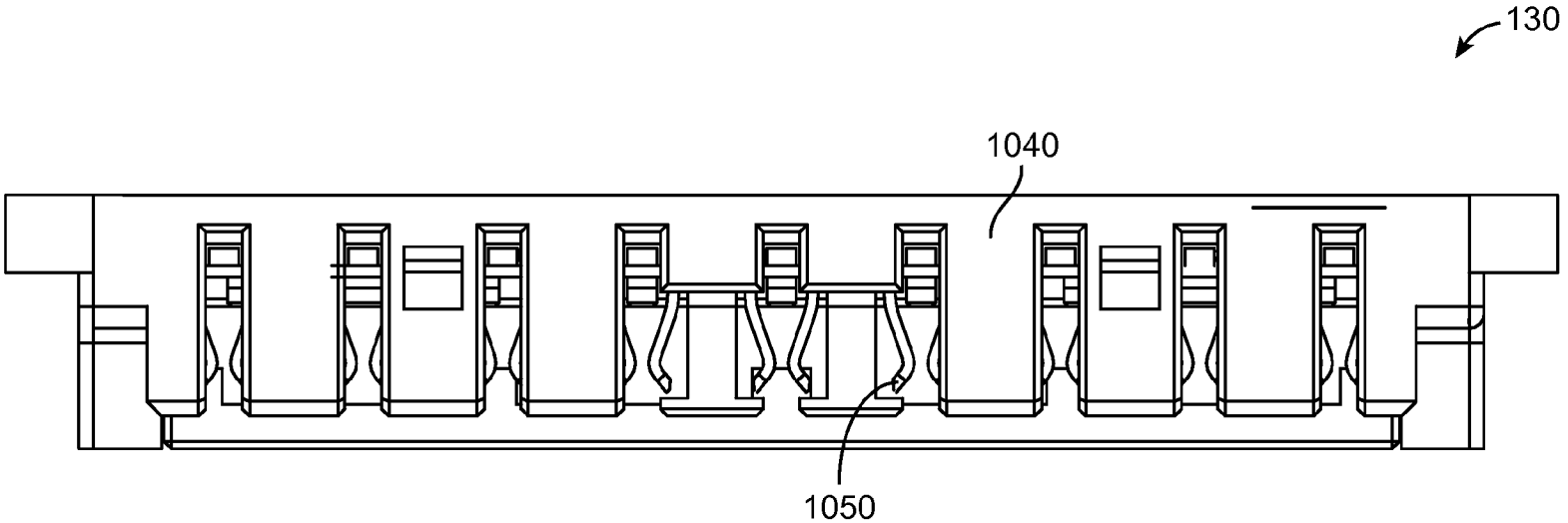
FIG. 14 illustrates a back side of a lid according to an embodiment of the present invention.

FIG. 14 illustrates a back side of a lid according to an embodiment of the present invention.

Figure 15:
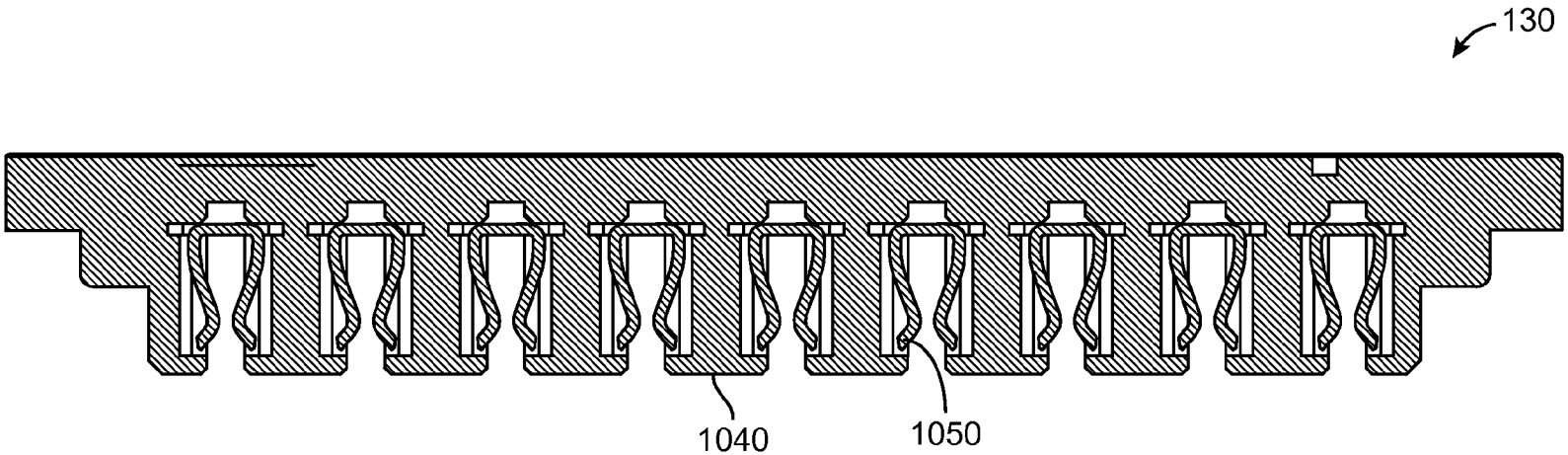
FIG. 15 illustrates a cutaway view of a lid according to an embodiment of the present invention.

FIG. 15 illustrates a cutaway view of a lid according to an embodiment of the present invention. Again, insulative portions 1040 isolate contact prongs 1050 from one another.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A battery connector to form a plurality of electrical paths between a printed circuit board and a battery, the battery connector comprising:

a socket comprising a first plurality of contacts; and a lid to mate with the socket, wherein the lid is flexible to facilitate its removal when the force is exerted on the first edge, the lid comprising:

a substantially flat surface having a first edge extending beyond the socket when the lid is mated to the socket, such that the lid may be removed by a force exerted on the first edge; and a second plurality of contacts to form electrical connections with the first plurality of contacts in the socket.

2. The battery connector of claim 1 wherein the surface has a second edge extending beyond the socket when the lid is mated to the socket, the second edge opposite the first edge.

3. The battery connector of claim 2 wherein the lid is flexible to facilitate its removal when the force is exerted on the first and second edges.

4. The battery connector of claim 1 wherein the socket comprises a key to mate with an open space in the lid.

5. The battery connector of claim 4 wherein the key and corresponding open space prevents misconnection of the lid and the socket.

6. The battery connector of claim 1 wherein the lid further comprises a plurality of conductors to couple to a battery.

7. The battery connector of claim 6 wherein the plurality of conductors comprises a flexible board.

8. The battery connector of claim 1 wherein the first plurality of contacts comprises contacts for power, ground, and a signal.

9. The battery connector of claim 8 wherein the signal contacts are recessed relative to the power and ground contacts, such that when the lid and socket are connected, power and ground connections are formed before a signal connection.

10. A lid for a battery connector, the lid comprising:

a substantially flat surface having a first edge extending beyond a socket when the lid is mated to the socket, such that the lid may be separated from the socket by a force exerted on the first edge; and a plurality of first contacts to form electrical connections with a plurality of second contacts in the socket, wherein the lid is flexible to facilitate its removal when the force is exerted on the first edge.

11. The lid for a battery connector of claim 10 wherein the surface has a second edge extending beyond the socket when the lid is mated to the socket, the second edge opposite the first edge.

12. The lid for a battery connector of claim 11 wherein the lid is flexible to facilitate its removal when the force is exerted on the first and second edges.

13. The lid for a battery connector of claim 10 wherein the lid comprises an open space, the open space to mate with a key on the socket.

14. The lid for a battery connector of claim 10 wherein the lid further comprises a plurality of conductors to couple to a battery.

15. The lid for a battery connector of claim 14 wherein the plurality of conductors comprises a flexible board.

16. The lid for a battery connector of claim 10 wherein the first plurality of contacts comprises contacts for power, ground, and a signal.

17. A battery connector comprising:

a socket comprising a first plurality of contacts; and a lid to mate with the socket, the lid comprising:

a second plurality of contacts arranged in a row in a first direction; and a flexible top surface having first and second edges extending beyond the socket in the first direction at each end of the socket, wherein the lid is flexible to facilitate its removal.

18. The battery connector of claim 17 wherein the lid is removed by exerting a force at the first and second edges.

19. The battery connector of claim 17 wherein the lid and socket further comprise a key structure comprising a key and an open space, the key to mate with the open space when the lid is mated with the socket.

20. The battery connector of claim 19 wherein the key and corresponding open space prevents misconnection of the lid and the socket.

21. The battery connector of claim 20 wherein the open space is located on the lid and the key is located on the socket.

22. The battery connector of claim 17 wherein the lid further comprises a plurality of conductors to couple to a battery.

23. The battery connector of claim 22 wherein the plurality of conductors comprises a flexible board.

24. The battery connector of claim 17 wherein the first plurality of contacts comprises contacts for power, ground, and a signal.

25. The battery connector of claim 24 wherein the signal contacts are recessed relative to the power and ground contacts, such that when the lid and socket are connected, power and ground connections are formed before a signal connection.

* * * * *